US010871793B2

(12) United States Patent
Namekawa et al.

(10) Patent No.: US 10,871,793 B2
(45) Date of Patent: Dec. 22, 2020

(54) CONSTANT VOLTAGE POWER SOURCE CIRCUIT

(71) Applicants: Kabushiki Kaisha Toshiba, Tokyo (JP); Toshiba Electronic Devices & Storage Corporation, Tokyo (JP)

(72) Inventors: Toshimasa Namekawa, Ota Tokyo (JP); Kosuke Tashiro, Kawasaki Kanagawa (JP)

(73) Assignees: Kabushiki Kaisha Toshiba, Tokyo (JP); Toshiba Electronic Devices & Storage Corporation, Tokyo (JP)

( * ) Notice: Subject to any disclaimer, the term of this patent is extended or adjusted under 35 U.S.C. 154(b) by 3 days.

(21) Appl. No.: 15/915,596

(22) Filed: Mar. 8, 2018

(65) Prior Publication Data

US 2019/0086943 A1 Mar. 21, 2019

(30) Foreign Application Priority Data

Sep. 19, 2017 (JP) ..... 2017-179594

(51) Int. Cl.

| | |
|---|---|
| ***G05F 1/575*** | (2006.01) |
| ***G05F 1/573*** | (2006.01) |
| ***G05F 1/46*** | (2006.01) |

(52) U.S. Cl.

CPC ..... *G05F 1/575* (2013.01); *G05F 1/468* (2013.01); *G05F 1/573* (2013.01)

(58) Field of Classification Search

CPC . G05F 1/575; G05F 1/56; G05F 1/565; G05F 1/10; G05F 1/573; G05F 1/468

See application file for complete search history.

(56) References Cited

U.S. PATENT DOCUMENTS

| | | | | |
|---|---|---|---|---|
| 6,975,099 | B2 | 12/2005 | Wu et al. | |
| 8,928,302 | B2 | 1/2015 | Namekawa | |
| 2005/0189930 | A1 | 9/2005 | Wu et al. | |
| 2007/0206338 | A1* | 9/2007 | Ishino | G05F 1/575 361/93.9 |
| 2010/0320980 | A1* | 12/2010 | Terada | G05F 1/575 323/282 |
| 2013/0169251 | A1 | 7/2013 | Wan et al. | |
| 2017/0077821 | A1 | 3/2017 | Namekawa | |

FOREIGN PATENT DOCUMENTS

| | | | |
|---|---|---|---|
| JP | 2005-243032 | A | 9/2005 |
| JP | 2006-164089 | A | 6/2006 |
| JP | 3986391 | B2 | 10/2007 |
| JP | 2012-164268 | A | 8/2012 |
| WO | 2006/016456 | A1 | 2/2006 |

* cited by examiner

*Primary Examiner* — Adolf D Berhane

(74) *Attorney, Agent, or Firm* — White & Case LLP

(57) ABSTRACT

According to an embodiment, a constant voltage power source circuit has a voltage feedback circuit that controls an output voltage depending on a control voltage. It has a current feedback circuit that detects an output current, keeps the control voltage at a constant voltage until the output current reaches a predetermined current value, and changes a value of the control voltage at a time when the output current reaches the predetermined current value.

14 Claims, 9 Drawing Sheets

CONSTANT VOLTAGE POWER SOURCE CIRCUIT

CROSS-REFERENCE TO RELATED APPLICATIONS

This application is based upon and claims the benefit of priority from Japanese Patent Application No. 2017-179594, filed on Sep. 19, 2017; the entire contents of which are incorporated herein by reference.

FIELD

The present embodiment generally relates to a constant voltage power source circuit.

BACKGROUND

A constant voltage power source circuit is conventionally disclosed that includes an overcurrent protection circuit in order to prevent breaking of a power source circuit or a load at a time when an overload state is caused. For example, an output transistor is turned off at a time when an overload state is caused, so that a protective operation is executed. However, in a case where an output transistor is turned off, a feedback loop that maintains a constant voltage is blocked, so that an output voltage is destabilized and a case may be caused where a normal return to a constant voltage state is not attained at a time when an overload state is eliminated. A constant voltage power source circuit is desired that is capable of stabilizing an output voltage in an overload state and returning to a constant voltage state smoothly.

DETAILED DESCRIPTION

According to one embodiment, a constant voltage power source circuit has a voltage feedback circuit that controls an output voltage depending on a control voltage. It has a current feedback circuit that detects an output current, keeps the control voltage at a constant voltage until the output current reaches a predetermined current value, and changes a value of the control voltage at a time when the output current reaches the predetermined current value.

Hereinafter, a constant voltage power source circuit according to an embodiment will be described in detail with reference to the accompanying drawings. Additionally, the present invention is not limited by such an embodiment.

First Embodiment

Figure 1:
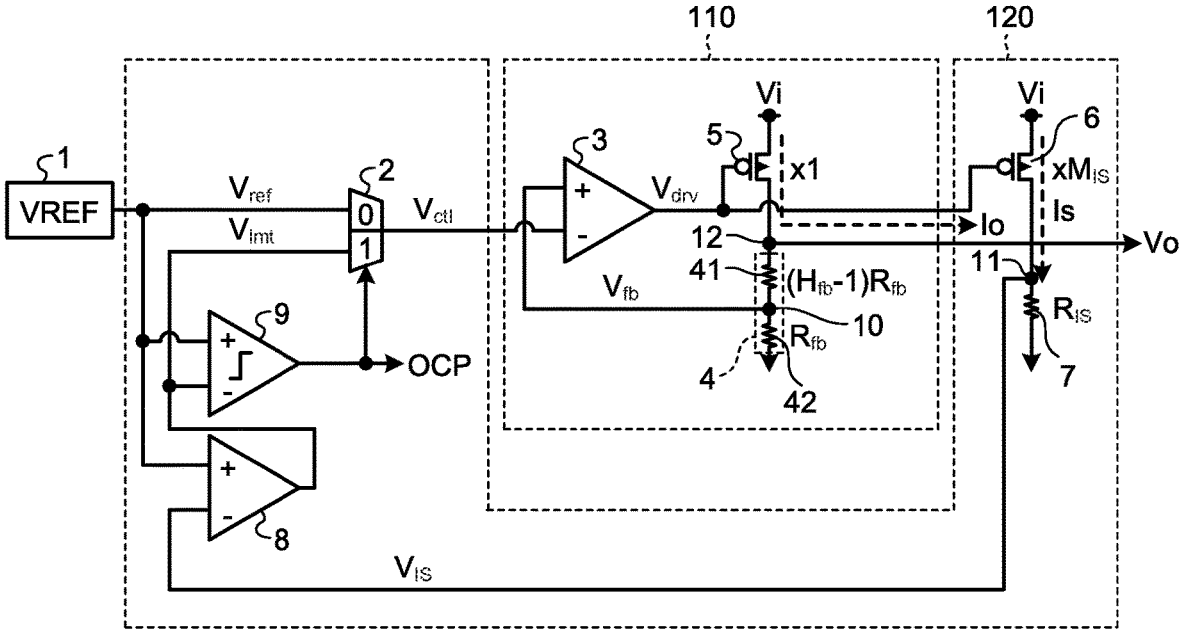
FIG. 1 is a diagram illustrating a constant voltage power source circuit according to a first embodiment.

FIG. 1 is a diagram illustrating a constant voltage power source circuit according to a first embodiment. A constant voltage power source circuit according to the present embodiment has a reference voltage source 1. The reference voltage source 1 outputs a reference voltage $V_{ref}$. The reference voltage $V_{ref}$ is supplied to a selection circuit 2.

The selection circuit 2 is composed of, for example, a transfer gate that is controlled by a detection signal OCP that is output from a comparator 9. The reference voltage $V_{ref}$ that is supplied from the reference voltage source 1 and a current limitation signal $V_{lmt}$ from a differential amplifier 8 are selected and output depending on a detection signal OCP. In a case where a detection signal OCP is "1", that is, a case where an overcurrent detection state is caused, the current limitation signal $V_{lmt}$ from the differential amplifier 8 is output, whereas, in a case where an overcurrent detection state is not caused, that is, a case where a detection signal OCP is "0", the reference voltage $V_{ref}$ is output as a voltage control signal $V_{ctl}$.

A voltage control signal $V_{ctl}$ from the selection circuit 2 is supplied to an inverting input terminal of a differential amplifier 3. A feedback signal $V_{fb}$ provided in such a manner that an output voltage $V_o$ is divided by a resistance voltage divider 4 is supplied to a non-inverting input terminal of the differential amplifier 3. The resistance voltage divider 4 has a serial connection of a resistance 41 and a resistance 42. The resistance 41 and the resistance 42 are connected at a connection terminal 10.

The differential amplifier 3 amplifies an electric potential difference between a feedback signal $V_{fb}$ and a voltage control signal $V_{ctl}$ to output a drive signal $V_{drv}$.

The drive signal $V_{drv}$ is commonly supplied to gate terminals of a PMOS output transistor 5 and a PMOS transistor 6.

The PMOS output transistor 5 is provided in such a manner that a source thereof is connected to a supply power source Vi and a drain thereof is connected to an output terminal 12 that outputs an output voltage $V_o$. The PMOS output transistor 5 controls an output current $I_o$ that is supplied from a supply power source Vi to a (non-illustrated) load in accordance with a voltage of the drive signal $V_{drv}$ that is supplied to a gate thereof.

The PMOS transistor 6 is provided in such a manner that a source thereof is connected to a supply power source Vi and a gate thereof is commonly connected to a gate of the PMOS output transistor 5, similarly to the PMOS output transistor 5. Accordingly, the PMOS output transistor 5 and the PMOS transistor 6 compose a current mirror circuit. It is desirable for the PMOS output transistor 5 and the PMOS transistor 6 to be elements that have an identical electrical characteristic.

Sizes of the PMOS output transistor 5 and the PMOS transistor 6 are adjusted, so that it is possible to set a ratio between current drive capabilities of both transistors. Such a ratio between current drive capabilities is referred to as a current mirror ratio. For example, a ratio of a size of the PMOS transistor 6 to that of the PMOS output transistor 5 is set in such a manner that a current drive capability of the PMOS transistor 6 is less than that of the PMOS output transistor 5, like 1 to 1000. In such a case, a current mirror ratio $M_{IS}$ is 1/1000 and a current that is $M_{IS}$ times as much as an output current $I_o$ that flows through the PMOS output transistor 5 flows through the PMOS transistor 6. That is, a current $I_s$ that flows through the PMOS transistor 6 is $I_s=M_{IS}\times I_o$. That is, the PMOS transistor 6 in a current feedback circuit 120 detects an output current $I_o$.

The current $I_s$ flows through a resistance 7, so that a voltage drop that is represented by $V_{IS}=I_s\times R_{IS}$ is caused at one end 11 of the resistance 7 where $R_{IS}$ is a resistance value of the resistance 7. The current detection signal $V_{IS}$ is provided to an inverting input terminal of the differential amplifier 8.

On the other hand, the reference voltage $V_{ref}$ that is an output signal from the reference power source 1 is supplied to a non-inverting input terminal of the differential amplifier 8.

The differential amplifier 8 amplifies an electric potential difference between the reference voltage $V_{ref}$ and the current detection signal $V_{IS}$ to output a current limitation signal $V_{lmt}$.

The current limitation signal $V_{lmt}$ is supplied to an active input terminal of the selection circuit 2 and simultaneously supplied to an inverting input terminal of the comparator 9.

On the other hand, the reference voltage $V_{ref}$ that is output from the reference voltage source 1 is supplied to a non-inverting input terminal of the comparator 9. The comparator 9 outputs "1" that indicates an overcurrent state, as a detection signal OCP in a case where an electric potential of a current limitation signal $V_{lmt}$ is lower than an electric potential of the reference voltage $V_{ref}$, or outputs "0" that indicates a non-overcurrent state in an opposite case.

As described previously, the selection circuit 2 selects the current limitation signal $V_{lmt}$ in a case where the detection signal OCP is an overcurrent detection state, that is, "1" or selects the reference voltage $V_{ref}$ in a case where a detection signal OCP is a non-overcurrent detection state, that is, "0", in accordance with a state of such a detection signal OCP that is output from the comparator 9, and outputs an electric potential thereof as a voltage control signal $V_{ctl}$.

An output voltage $V_o$ is input to the resistance voltage divider 4 and the resistance voltage divider 4 outputs a feedback signal $V_{fb}$ ($=V_o/H_{fb}$) that is obtained based on a voltage dividing ratio $H_{fb}$. The feedback signal $V_{fb}$ is fed back to the differential amplifier 3 and control is executed in such a manner that a voltage of the feedback signal $V_{fb}$ coincides with a voltage of a voltage control signal $V_{ctl}$, due to action of the differential amplifier 3. That is, the output voltage $V_o$ is controlled so as to be $V_{ctl}\times H_{fb}$.

As a voltage of a feedback signal $V_{fb}$ is increased, a voltage at a non-inverting input terminal of the differential amplifier 3 rises. Thereby, a drive signal $V_{drv}$ rises, so that a gate voltage of the MOS output transistor 5 rises. Accordingly, an electrical conductivity of the PMOS output transistor 5 drops, so that an output current $I_o$ decreases to lower an output voltage $V_o$. That is, a voltage feedback circuit 110 composes a negative feedback loop.

Due to such action, an output current $I_o$ in an overload state is limited to a value that is defined by $I_o=V_{ref}/R_{IS}/M_{IS}$. On the other hand, in a non-overload state, that is, a normal operation state, an output voltage $V_o$ operates as a constant voltage source that is defined by $V_o=V_{ref}-H_{fb}$.

Figure 2:
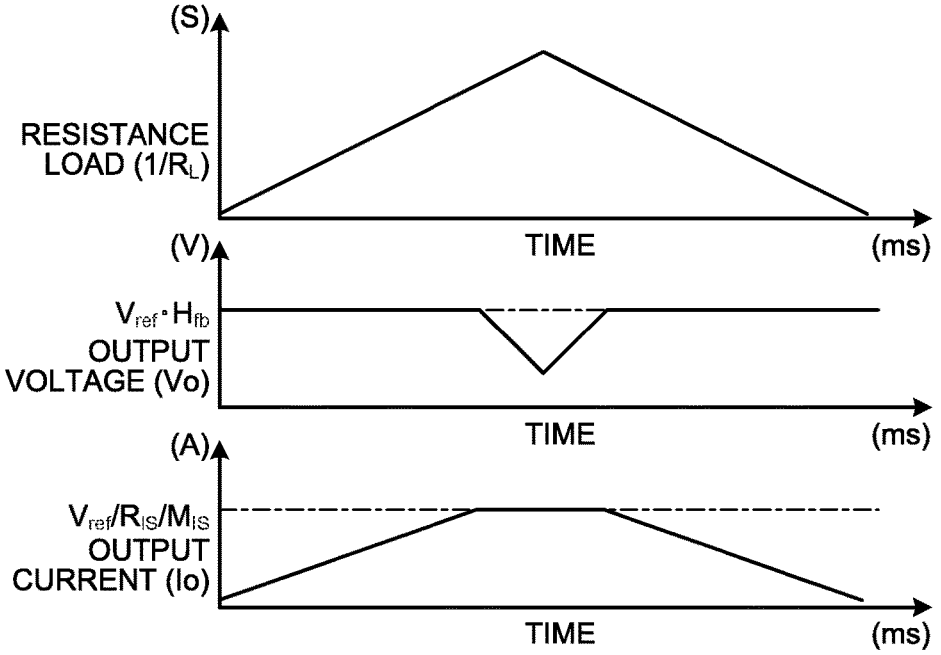
FIG. 2 is a diagram illustrating an operation waveform of a constant voltage power source circuit according to the first embodiment.

FIG. 2 is a diagram illustrating an operation waveform of a power source circuit according to the first embodiment. An upper view, a middle view, and a lower view of FIG. 2 illustrate a resistance load ($1/R_L$), an output voltage $V_o$, and an output current $I_o$, respectively. The output current $I_o$ increases with decreasing a load resistance $R_L$, so that a resistance load is conveniently represented by $1/R_L$ that is an inverse of such a resistance $R_L$. A similar matter applies to the following. An operation waveform diagram of FIG. 2 illustrates the output voltage $V_o$ and the output current $I_o$ of the output terminal 12 in a case where a (non-illustrated) resistance load that is connected to the output terminal 12 gradually increases from a light state, then reaches an overload state, and returns to the light state again.

In a state where a resistance load is light, that is, in a light state (normal operation state) as represented by $V_o/R_L<V_{ref}/R_{IS}/M_{IS}$, the output voltage $V_o$ indicates a constant value as represented by $V_{ref}\cdot H_{fb}$.

The output current $I_o$ gradually increases with gradually increasing a resistance load ($1/R_L$), as represented by $I_o=V_{ref}\cdot H_{fb}/R_L$.

Then, in a case where a resistance load is in an overload state as represented by $V_o/R_L>V_{ref}/R_{IS}/M_{IS}$, the output current $I_o$ is limited to a constant value that is represented by $V_{ref}/R_{IS}/M_{IS}$ and the output voltage $V_o$ is lowered as represented by $R_L\cdot V_{ref}/R_{IS}/M_{IS}$.

That is, such a state is an overcurrent protection state where the output voltage $V_o$ is lowered to limit a current that flows through a load and prevent a trouble such as heat generation or breaking. As a resistance load ($1/R_L$) decreases again, the output voltage $V_o$ rises accordingly and returns to a constant voltage state in a case where an overload state is eliminated.

Figure 3:
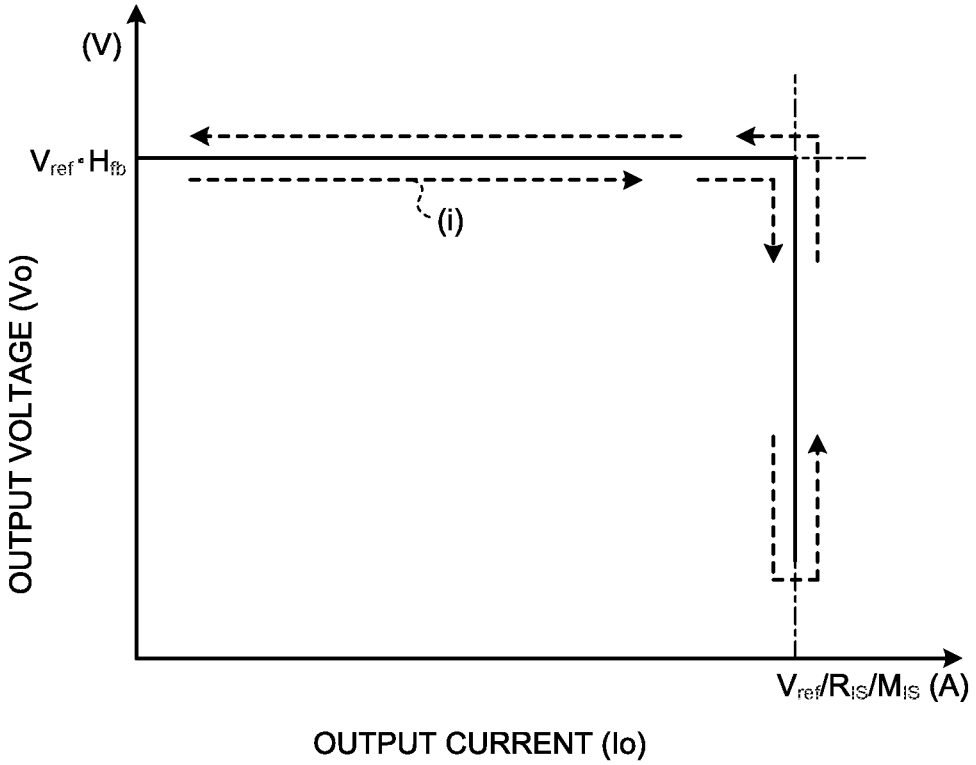
FIG. 3 is a diagram illustrating a voltage-current characteristic of a constant voltage power source circuit according to the first embodiment.

FIG. 3 is a diagram illustrating a voltage-current characteristic of a constant voltage power source circuit according to the first embodiment. A horizontal axis and a vertical axis represent an output current $I_o$ and an output voltage $V_o$, respectively. As illustrated in FIG. 3, a voltage-current characteristic of a constant voltage power source circuit according to the first embodiment is provided in such a manner that an output voltage $V_o$ is steeply lowered so as to bend by 90 degrees at a coordinate point ($V_{ref}/R_{IS}/M_{IS}$) where an output current $I_o$ is in an overcurrent state. That is, a dropping type overcurrent protection characteristic is indicated therein. Then, it returns to a constant voltage state in a case where an overload state is eliminated. That is, an operation characteristic is illustrated that describes a trajectory as indicated by a dotted line (i).

A constant voltage power source circuit according to the present embodiment has the voltage feedback circuit 110 that controls an output voltage $V_o$ in such a manner that a feedback signal $V_{fb}$ with a divided voltage is equal to a voltage of a voltage control signal $V_{ctl}$. In a steady state, an output voltage $V_o$ is controlled so as to be equal to a predetermined voltage value of $V_{ref}\cdot H_{fb}$.

As an overcurrent state is caused, the output voltage $V_o$ is lowered steeply. However, even in an overcurrent state, the voltage feedback circuit 110 operates normally. In an overcurrent state, control is executed in such a manner that a voltage of a voltage control signal $V_{ctl}$ that is followed by an output voltage $V_o$ is changed from a reference voltage $V_{ref}$ that is a constant voltage to a current limitation signal $V_{lmt}$ that is changed depending on a difference voltage between the reference voltage $V_{ref}$ and a current detection signal $V_{IS}$ that is changed depending on an output current $I_o$.

Control to switch a voltage control signal $V_{ctl}$ that is output from the selection circuit 2 between a reference voltage $V_{ref}$ and a current limitation signal $V_{lmt}$ is executed based on a result of comparison between the reference voltage $V_{ref}$ and the current limitation signal $V_{lmt}$ that is executed by the comparator 9. That is, it is executed under control of the current feedback circuit 120.

Although the current limitation signal $V_{lmt}$ is changed depending on a difference voltage between the reference voltage $V_{ref}$ and the current detection signal $V_{IS}$ that is changed depending on the output current $I_o$, an upper limit value of the voltage control signal $V_{ctl}$ that is output from the selection circuit 2 is the reference voltage $V_{ref}$. Furthermore, the output current $I_o$ is limited by a coordinate point ($V_{ref}/R_{IS}/M_{IS}$) for an overcurrent state. That is, control is executed in such a manner that the output current $I_o$ in the overcurrent state is constant.

At a time when an output current $I_o$ reaches a set current value ($V_{ref}/R_{IS}/M_{IS}$), control is executed in such a manner that a voltage of the voltage control signal $V_{ctl}$ that is supplied to a gate of the PMOS output transistor 5 in the voltage feedback circuit 110 is changed from the reference voltage $V_{ref}$ to the current limitation signal $V_{lmt}$.

Therefore, a voltage-current characteristic is not different between a time of transfer to overcurrent protection and a time of returning therefrom, and further, the output voltage $V_o$ does not overshoot at a time of elimination of an overload state. It is possible to provide a constant voltage power source circuit that prevents an excessive output current $I_o$ from flowing even in an overload state, and further, is safe in such a manner that the output voltage $V_o$ does not overshoot to a high voltage even at a time of returning therefrom.

Second Embodiment

Figure 4:
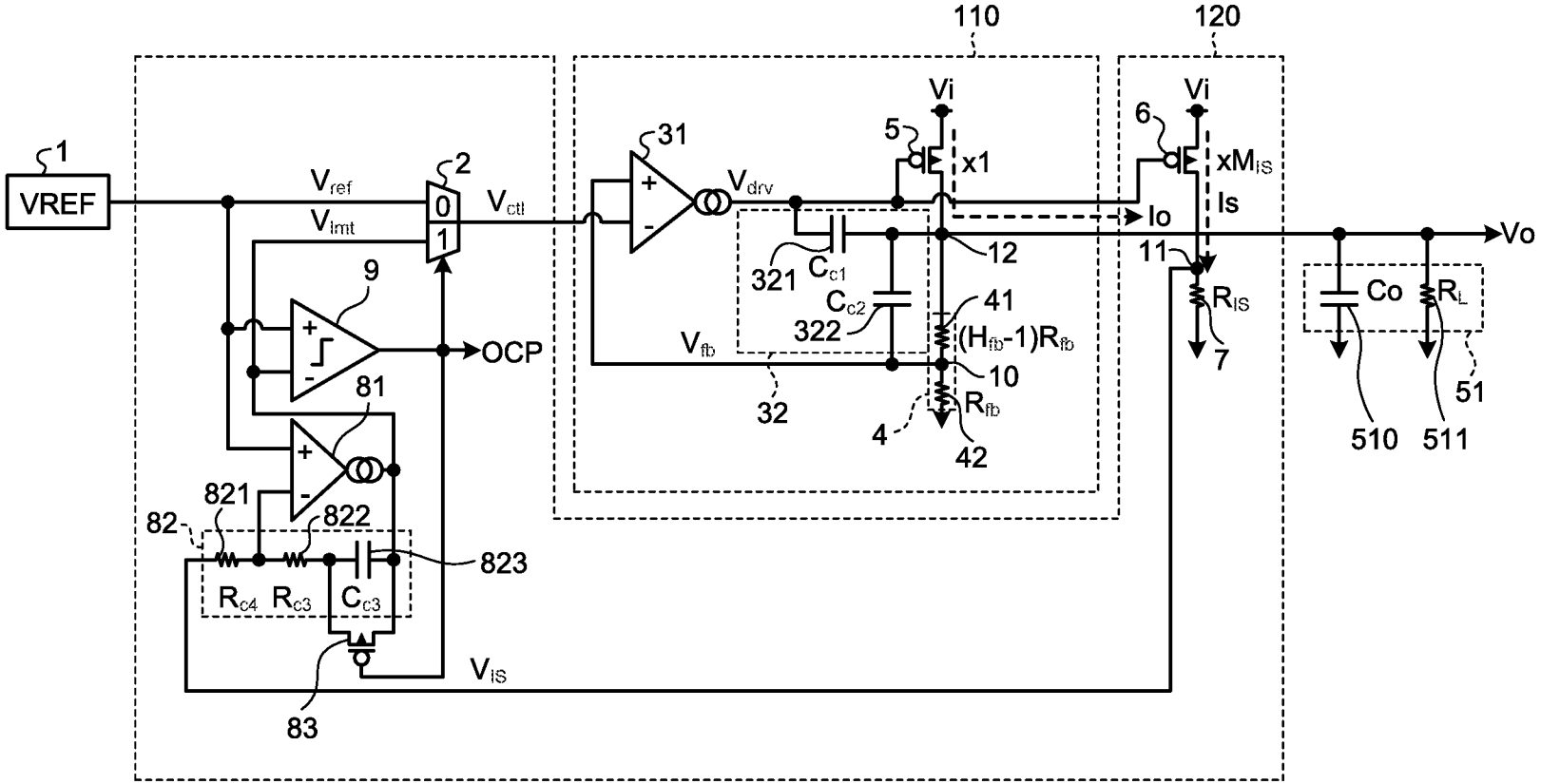
FIG. 4 is a diagram illustrating a constant voltage power source circuit according to a second embodiment.

FIG. 4 is a diagram illustrating a constant voltage power source circuit according to a second embodiment. A component that corresponds to that in an embodiment as already described is provided with an identical sign. A constant voltage power source circuit according to the present embodiment includes a smoothing capacitor 510 at an output terminal 12. The smoothing capacitor 510 is connected to a load resistance 511 in parallel. The smoothing capacitor 510 reduces a ripple of an output voltage $V_o$ and supplies a stable voltage to the load resistance 511. Conveniently, a load 51 is composed of the smoothing capacitor 510 and the load resistance 511.

A voltage feedback circuit 110 in the constant voltage power source circuit according to the present embodiment includes a differential voltage current amplifier 31 and a phase compensation circuit 32. The differential voltage current amplifier 31 outputs a current that is provided by multiplying a voltage difference between a non-inverting input terminal and an inverting input terminal thereof by a gain of the differential voltage current amplifier 31.

The phase compensation circuit 32 has two phase compensation capacitances 321 and 322.

A current feedback circuit 120 includes a differential voltage current amplifier 81, a phase compensation circuit 82, and a magnification changing switch 83. The differential voltage current amplifier 81 outputs a current that is provided by multiplying a voltage difference between a non-inverting input terminal and an inverting input terminal thereof by a gain of the differential voltage current amplifier 81.

The phase compensation circuit 82 has a capacitance 823 and two resistances 821 and 822.

Figure 5:
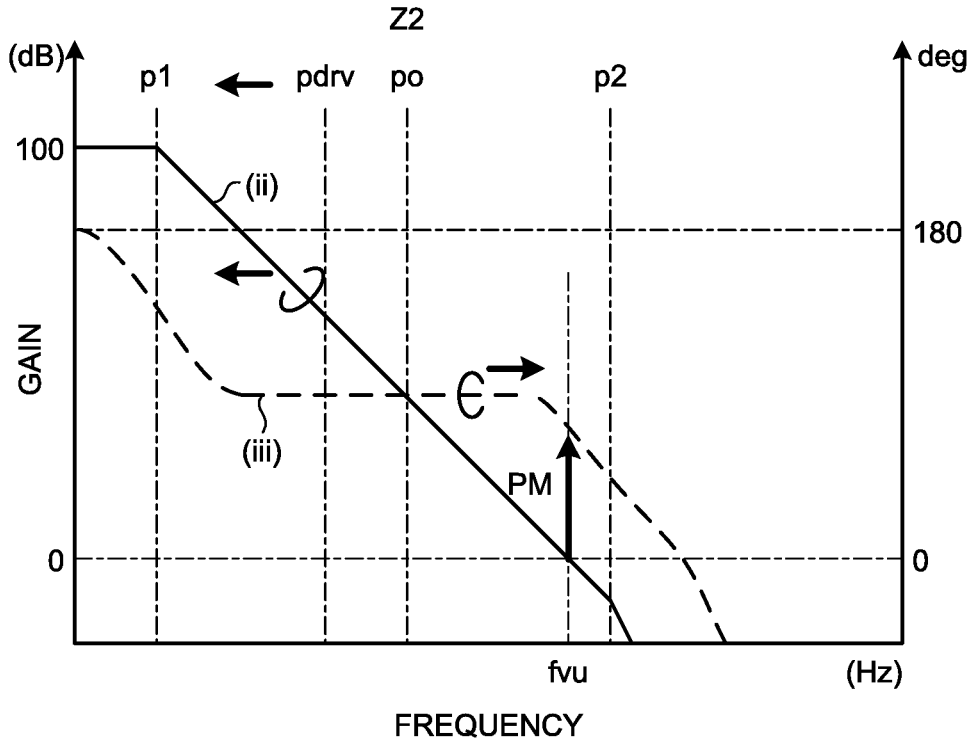
FIG. 5 is a diagram illustrating a signal transmission characteristic of a voltage feedback loop of a constant voltage power source circuit according to the second embodiment.

A stability of feedback control of the voltage feedback circuit 110 in the constant voltage power source circuit according to the present embodiment will be described. FIG. 5 illustrates a Bode diagram of an open loop small-signal transmission characteristic in a case where a feedback signal $V_{fb}$ is disconnected. In FIG. 5, a solid line (ii) indicates a gain and a dotted line (iii) indicates a phase.

First, a gate terminal and a drain terminal of the PMOS output transistor 5 are connected by the capacitance 321 in the phase compensation circuit 32, so that a frequency of a driver pole pdrv is lowered to be set at a first pole p1. Herein, a capacitance $C_{C1}$ of the capacitance 321 is adjusted to determine a voltage feedback control unity gain frequency fvu for voltage feedback control.

Then, an output voltage $V_o$ and a feedback signal $V_{fb}$ are connected by the capacitance 322 and a resistance 42, so that a pole p2 and a zero Z2 are added thereto. Herein, magnitudes of a capacitance $C_{C2}$ of the capacitance 322 and a resistance value $R_{fb}$ of the resistance 42 are adjusted, so that a frequency of the zero Z2 to be added coincides with and is canceled by a frequency of an output power source pole po and the pole p2 to be added is set so as to be higher than a voltage feedback control unity gain frequency fvu. Thus, a phase margin PM is set at, for example, approximately 60 degrees, so that a stability of negative feedback control of the voltage feedback circuit 110 is ensured.

The smoothing capacitor 510 is provided at the output terminal 12, so that a delay is caused in feedback control of the voltage feedback circuit 110. A gain of the voltage feedback circuit 110 is lowered by the phase compensation circuit 32 to compensate for a phase delay thereof, so that it is possible to prevent oscillation of the voltage feedback circuit 110. It is possible to change a configuration of the phase compensation circuit 32 appropriately, depending on a desired characteristic thereof.

Figure 6:
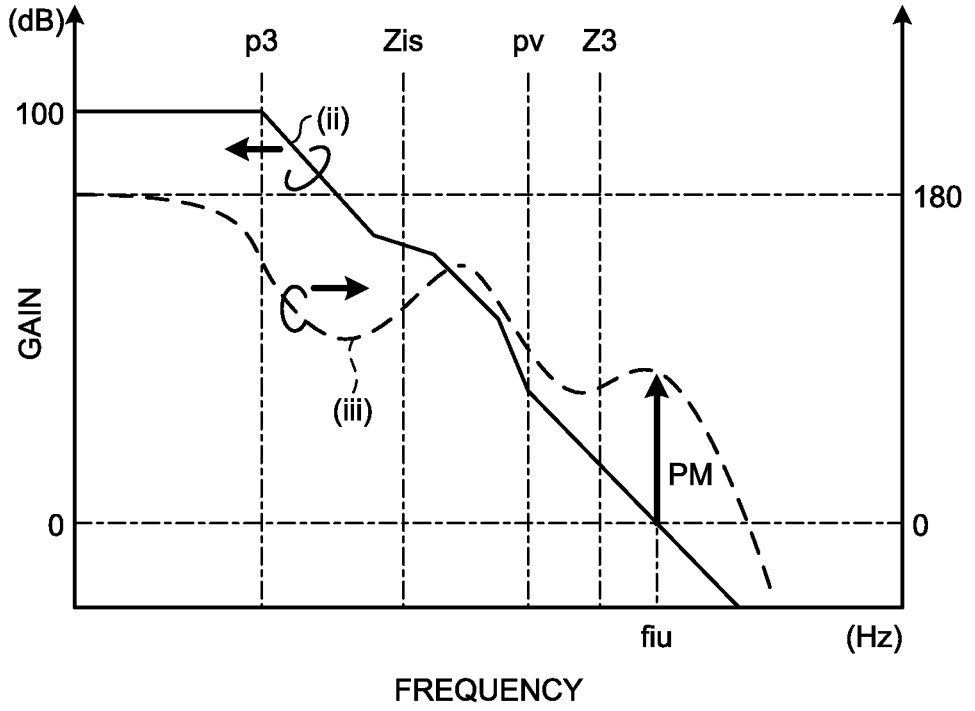
FIG. 6 is a diagram illustrating a signal transmission characteristic of a current feedback loop of a constant voltage power source circuit according to the second embodiment.

Next, a stability of feedback control of the current feedback circuit 120 in the power source circuit according to the present embodiment will be described by using FIG. 6. In FIG. 6, a solid line (ii) indicates a gain and a dotted line (iii) indicates a phase.

Stabilization of a feedback control system of the current feedback circuit 120 is attained by connecting the phase compensation circuit 82 thereto. First, the capacitance 823 and the resistance 822 of the phase compensation circuit 82 are connected in series to connect an output terminal and an inverting input terminal of the differential voltage current amplifier 81. Thereby, a current limitation pole moves to a low frequency so as to be a phase compensation pole for current feedback control p3 and a phase compensation zero point for current feedback control Z3 is generated in a high-frequency region.

Herein, magnitudes of a capacitance $C_{C3}$ of the capacitance 823 and a resistance value $R_{C3}$ of the resistance 822 are adjusted in such a manner that a voltage feedback control pole pv and a current sense zero point Zis are interposed between a phase compensation pole for current feedback control p3 and a phase compensation zero point for current feedback control Z3.

Additionally, attention is needed, because a frequency of a current sense zero point Zis varies depending on a magnitude of a load that is connected to the output terminal 12.

A current detection signal $V_{IS}$ is supplied to an inverting input terminal of the differential voltage current amplifier 81 through the resistance 821. Herein, a magnitude of a resistance value $R_{C4}$ of the resistance 821 is adjusted and set in such a manner that a frequency where a current feedback control open loop gain is an equal magnification (0 dB), that is, a current feedback control unity gain frequency fiu is several times as much as a magnitude at a phase compensation zero point for current feedback control Z3. That is, the resistance 821 is used for gain adjustment.

Thus, if it is possible to set a phase margin PM in a current feedback control unity gain frequency fiu at approximately 60 degrees, it is possible to ensure stability of a feedback operation of the current feedback circuit 120.

If frequencies of non-illustrated miscellaneous poles are lower than the current feedback control unity gain frequency fiu so that it is not possible to obtain a phase margin PM with a sufficient magnitude, it is possible to adjust a resistance value $R_{C4}$ of the resistance 821 to keep the current feedback control unity gain frequency fiu low and adjust a capacitance $C_{C3}$ of the capacitance 823 and a resistance value $R_{C3}$ of the resistance 822 to keep a frequency of a phase compensation zero point Z3 low.

A constant voltage power source circuit according to the present embodiment has the magnification changing switch 83. The magnification changing switch 83 receives a detection signal OCP and causes short circuit between both end terminals of the capacitance 823 in the phase compensation circuit 82 in a case of a non-overcurrent state. Due to such action, in a case of a non-overcurrent state, the differential voltage current amplifier 81 operates as an inverting amplifier with a voltage amplification factor that is set based on a ratio between resistance values of the resistance 822 and the resistance 821.

Simultaneously, a detection signal OCP controls a connection state of the selection circuit 2. The selection circuit 2 outputs a current limitation signal $V_{lmt}$ that is output from the differential voltage current amplifier 81 as a voltage control signal $V_{ctl}$ in a case of an overcurrent protection state and switches a voltage control signal $V_{ctl}$ to a reference voltage $V_{ref}$ that is output from a reference voltage source 1 in a case of a non-overcurrent protection state.

In a constant voltage power source circuit according to the present embodiment, the magnification changing switch 83 keeps down an output of the differential voltage current amplifier 81 and a voltage of a current limitation signal $V_{lmt}$ within a range of 1.2 to 2 V in a case of a non-overcurrent state, so that the capacitance 823 in the phase compensation circuit 82 is prevented from being a saturation state thereof.

Due to such an operation, a settling time period for returning the current feedback circuit 120 to an equilibrium state thereof is shortened in a case where an overload state is caused again, so that it is possible to transfer to an overcurrent protection state immediately. Additionally, the magnification changing switch 83 is not limited to a PMOS transistor and it is sufficient to be a switch that is capable of receiving a detection signal OCP and thereby switching between a short circuit state and an open state.

Figure 7:
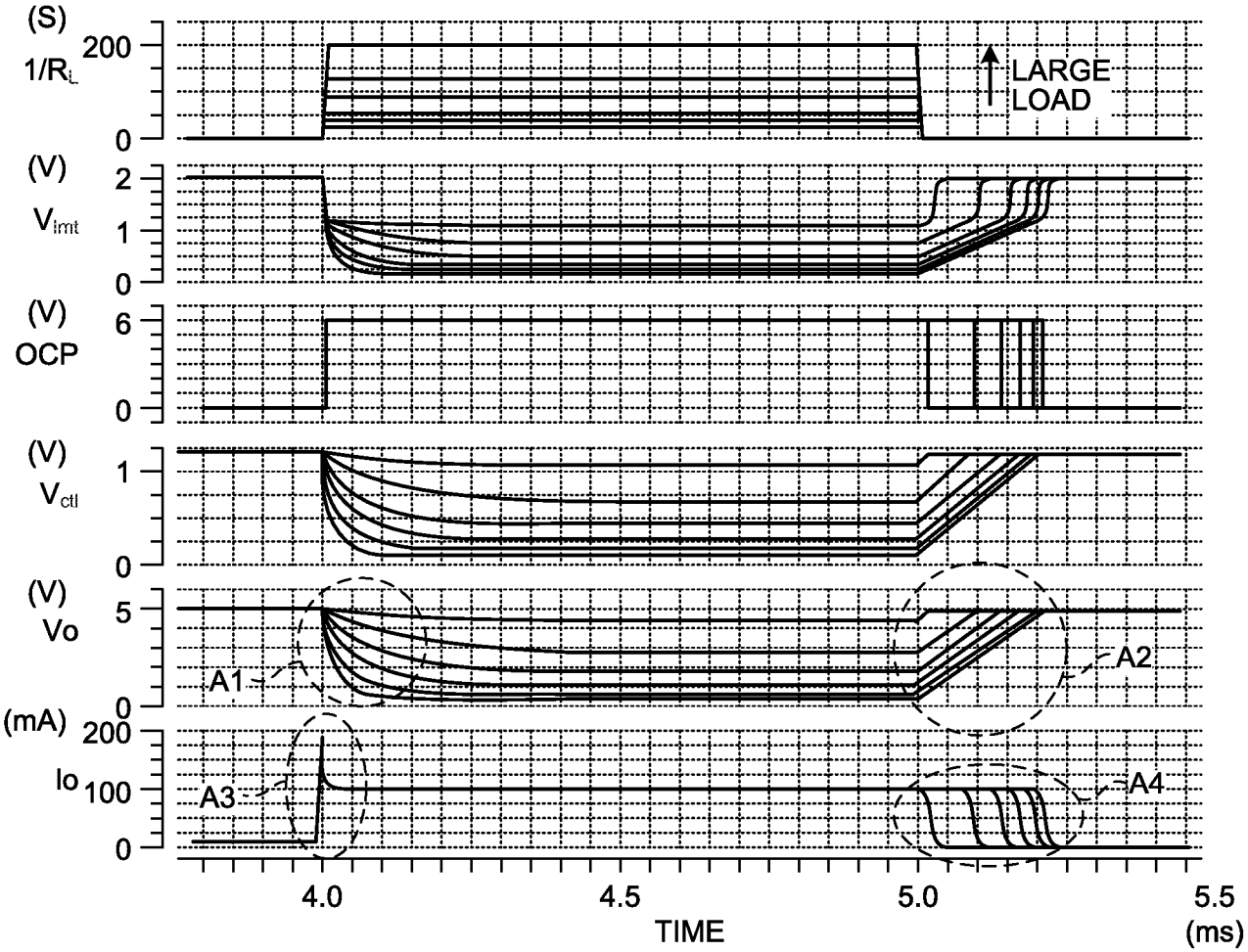
FIG. 7 is a diagram illustrating a response characteristic for a load variation of a constant voltage power source circuit according to the second embodiment.

FIG. 7 illustrates an operation waveform diagram of a constant voltage power source circuit according to the second embodiment. Such an operation waveform diagram represents behavior of an output voltage $V_o$ and an output current $I_o$ in a case where a resistance load ($1/R_L$) that is connected to the output terminal 12 instantaneously changes from a light state (2 mS: siemens) to a heavy state (24 mS to 200 mS), then a predetermined period of time has passed, and subsequently an instantaneous change to the light state (2 mS) is executed again.

FIG. 7 illustrates a resistance load ($1/R_L$) in an uppermost view and further illustrates a current limitation signal $V_{lmt}$, a detection signal OCP, a voltage control signal $V_{ctl}$, an output voltage $V_o$, and an output current $I_o$ toward a lowermost view.

First, an overcurrent protection operation will be described. As illustrated in a waveform in an uppermost view of FIG. 7, a resistance load ($1/R_L$) instantaneously increases at a time of 4 ms (seconds).

Accordingly, as indicated by a dotted circle A1 in a waveform diagram of the output voltage $V_o$ in FIG. 7, the output voltage $V_o$ drops slightly. The voltage feedback circuit 110 responds to the drop of the output voltage $V_o$ to return the output voltage $V_o$ to an original voltage, so that an output current $I_o$ increases rapidly.

The differential voltage current amplifier 81 responds to such an increase of the output current $I_o$ and rapidly drops a voltage of a current limitation signal $V_{lmt}$. As a current limitation signal $V_{lmt}$ is less than a voltage of a reference voltage $V_{ref}$, for example, 1.2 V, a comparator 9 determines that it is an overload state and causes a detection signal OCP to be at a high electric potential.

The selection circuit 2 receives the detection signal OCP and switches a voltage control signal $V_{ctl}$ that has ever been a reference voltage $V_{ref}$ to a current limitation signal $V_{lmt}$. Due to such action, a voltage of a voltage control signal $V_{ctl}$ gradually drops from 1.2 V.

The voltage feedback circuit 110 drops an output voltage $V_o$ with dropping a voltage of the current limitation signal $V_{lmt}$. An output current $I_o$ that has once increased rapidly drops rapidly again with dropping the output voltage $V_o$ and is stably kept at a setting value for overcurrent protection ($V_{ref}/R_{IS}/M_{IS}$: for example, 100 mA) due to control of the current feedback circuit 120.

Herein, in a case where a resistance load ($1/R_L$) rapidly increases from 1 mS to 200 mS during a short period of time, for example, 10 μs as illustrated in FIG. 7, an output current $I_o$ greatly exceeds a setting value for overcurrent protection of 100 mA and reaches approximately 200 mA that is twice an amount thereof as indicated by a dotted circle A3 in a waveform diagram of the output current $I_o$ in a lowermost view of FIG. 7.

Nevertheless, a magnitude of such an output current $I_o$ is kept small at a value that is greatly smaller than an amount of current (1 A) that is obtained from a magnitude of a load ($1/R_L$: 200 mS) and a setting value 5 V for an output voltage $V_o$. Furthermore, a period of time when such an output current $I_o$ exceeds a setting value for overcurrent protection is approximately 2 μs until a detection signal OPC responds thereto. In a case where a value of an output current $I_o$ at a time when it exceeds a setting value for overcurrent protection and a period of time thereof are kept short at such degrees, a failure such as breaking of the PMOS output transistor 5 is not caused.

Next, an overcurrent protection cancelation operation will be described. As indicated by a waveform in an uppermost view of FIG. 7, a resistance load ($1/R_L$) instantaneously decreases to 2 mS at a time of 5 ms. Accordingly, an output voltage $V_o$ starts to rise (recover) as indicated by a dotted circle A2. Furthermore, an output current $I_o$ starts to decrease as indicated by a dotted circle A4.

A recovery rate of such an output voltage $V_o$ is limited suitably. This is caused by action of the current feedback circuit 120 and because a sum of a current that charges a capacitance $C_o$ of the smoothing capacitor 510 that is connected to the output terminal 12 and a current that flows through a load resistance ($1/R_L$) is kept at 100 mA that is a setting value for overcurrent protection ($=V_{ref}/R_{IS}/M_{IS}$).

A voltage of a current limitation signal $V_{lmt}$ also rises with recovering an output voltage $V_o$. In a case where such a current limitation signal $V_{lmt}$ is higher than a voltage of a reference voltage $V_{ref}$ (=1.2 V), the comparator 9 determines that overcurrent protection is cancelled and causes a detection signal OCP to be at a low electric potential. In response to the detection signal OCP at the low electrical potential, the selection circuit 2 switches the voltage control signal $V_{ctl}$ that has ever been the current limitation signal $V_{lmt}$ to the reference voltage $V_{ref}$.

Subsequently, it operates as a constant voltage power source circuit again. In such a current protection operation and a returning operation thereof, a control loop of the voltage feedback circuit 110 is not disconnected, so that a failure such as an output voltage $V_o$ being destabilized or a setting value being exceeded to overshoot is not caused.

Furthermore, although a control loop of the current feedback circuit 120 is disconnected after returning to a constant voltage operation, the magnification changing switch for current feedback control 83 is instead provided in an electrical conduction state thereof. Accordingly, the differential voltage current amplifier 81 operates as an inverting amplifier and a voltage of a current limitation signal $V_{lmt}$ that is an output thereof is kept at 1.2 V to 2 V depending on a magnitude of an output current $I_o$. Thus, a magnitude of an output current $I_o$ is monitored constantly, so that it is possible to start an overcurrent protection operation instantaneously in a case where a next overload state is caused.

It is possible for a constant voltage power source circuit according to the present embodiment to prevent an output current $I_o$ thereof from being excessively large and keep a stable current output, even in a case where an output load rapidly transfers to an overload state. Moreover, in a constant voltage power source circuit according to the present embodiment, a recovery operation of an output voltage $V_o$ thereof is controlled appropriately in a case where an overload state is rapidly eliminated, so that a voltage thereof does not exceed a setting value or overshoot. Thereby, even in a case where a connected load varies rapidly, a safety is kept without breaking a load or a constant voltage power source circuit.

Third Embodiment

Figure 8:
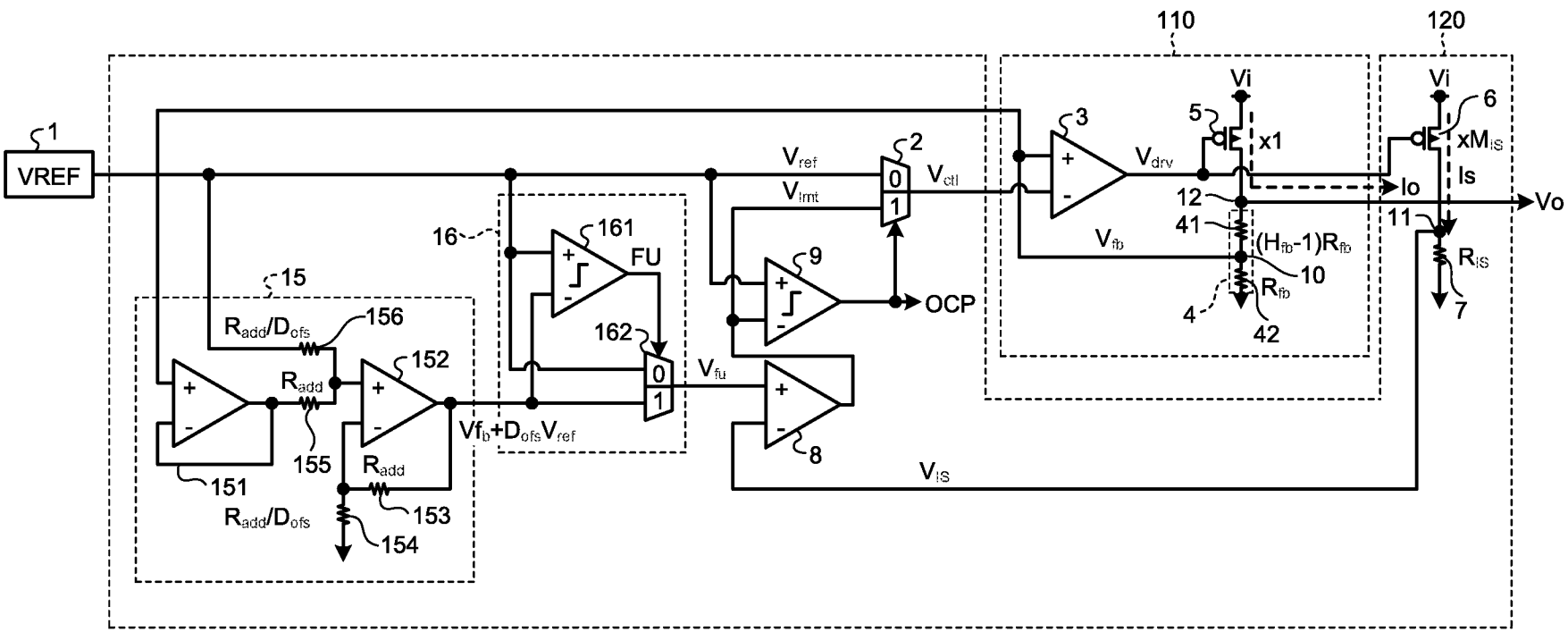
FIG. 8 is a diagram illustrating a constant voltage power source circuit according to a third embodiment.

FIG. 8 illustrates a constant voltage power source circuit according to a third embodiment. A constant voltage power source circuit according to the present embodiment is an example where a foldback current limiting characteristic signal generator 15 and an overcurrent protection characteristic switch 16 are added to a constant voltage power source circuit according to the first embodiment as illustrated in FIG. 1. Other parts are similar to those of a constant voltage power source circuit according to the first embodiment, so that an identical component is provided with an identical sign to avoid a redundant descriptions thereof.

The foldback current limiting characteristic signal generator 15 is composed of a voltage follower 151, an offset adder 152, and resistance elements 155 and 156. A resistance value of the resistance element 156 has a value ($R_{add}/D_{ofs}$) provided in such a manner that a resistance value $R_{add}$ of the resistance element 155 is divided by an offset ratio $D_{ofs}$.

The overcurrent protection characteristic switch 16 is composed of a comparator 161 and a selection circuit 162.

The voltage follower 151 receives a feedback signal $V_{fb}$ that is an output of a resistance voltage divider 4 and outputs a signal with a voltage that is identical to a voltage thereof. Such an output signal is wire-connected to a reference voltage $V_{ref}$ that is an output of a reference voltage source 1 by the resistance elements 155 and 156 and a midpoint therebetween is connected to a non-inverting terminal of the offset adder 152.

Resistance elements 153 and 154 are connected in series to wire-connect an output terminal of the offset adder 152 and a ground power source and a connection point of the resistance elements 153 and 154 is connected to an inverting terminal of the offset adder 152.

Thus configured foldback current limiting characteristic signal generator 15 outputs a signal with a voltage ($V_{fb}+V_{ref}\cdot D_{ofs}$) provided in such a manner that a voltage provided by multiplying a reference voltage $V_{ref}$ by an offset ratio $D_{ofs}$ is added to a voltage of a feedback signal $V_{fb}$.

An output signal ($V_{fb}+V_{ref}\cdot D_{ofs}$) from the foldback current limiting characteristic signal generator 15 is supplied to an inverting input terminal of the comparator 161 and a reference voltage $V_{ref}$ is supplied to a non-inverting input terminal of the comparator 161.

Similarly, an output signal ($V_{fb}+V_{ref}\cdot D_{ofs}$) from the foldback current limiting characteristic signal generator 15 is supplied to one input terminal of the selection circuit 162 and a reference voltage $V_{ref}$ is supplied to the other input terminal of the selection circuit 162. A selection signal FU that is an output of the comparator 161 is supplied to a control terminal of the selection circuit 162.

The overcurrent protection characteristic switch 16 selects, and outputs as a protection signal $V_{fu}$, either of ($V_{fb}+V_{ref}\cdot D_{ofs}$) and a reference voltage $V_{ref}$ in response to a selection signal FU.

Figure 9:
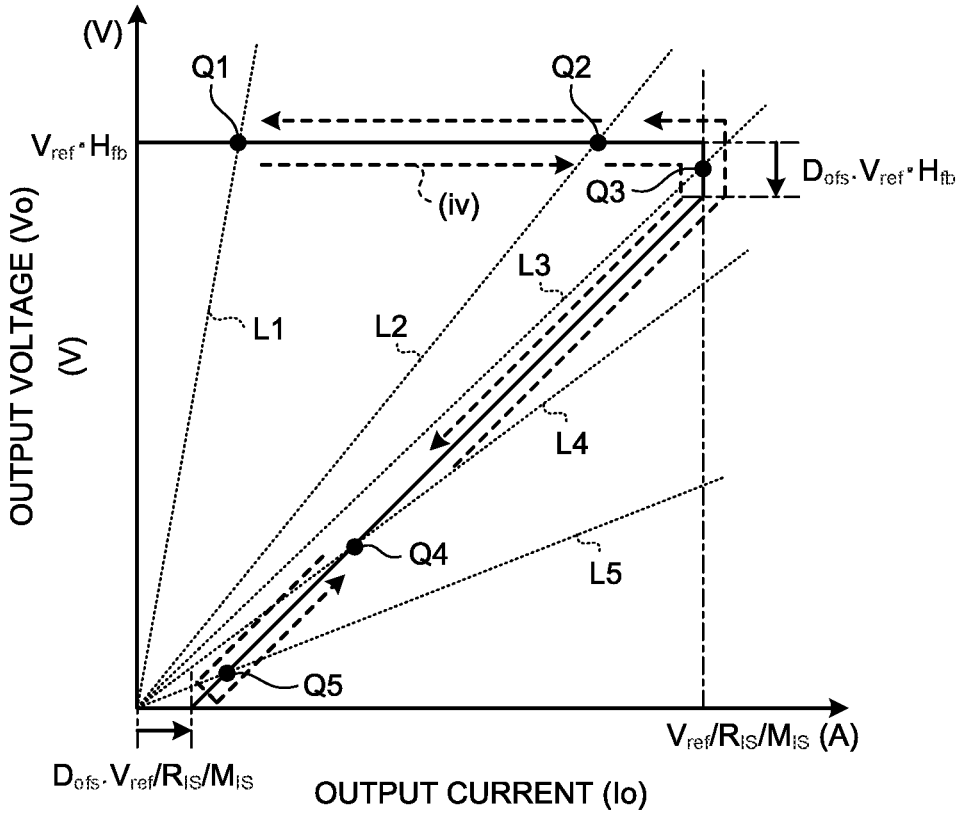
FIG. 9 is a diagram illustrating a voltage-current characteristic of a power source circuit according to the third embodiment.

FIG. 9 illustrates a voltage-current characteristic of a constant voltage power source circuit according to the present embodiment. Such a constant voltage power source circuit operates as a constant voltage source in a normal state with a light load.

As a load increases and a slope of a load straight line decreases (L1 to L5) as indicated by a dotted line in FIG. 9, an output current $I_o$ increases while an output voltage $V_o$ is $V_{ref}\cdot H_{fb}$ and remains constant. Points of intersection between respective load straight lines (L1 to L5) and a voltage-current characteristic curved line are denoted by Q1 to Q5. Points of intersection Q1 to Q5 between a voltage-current characteristic curved line and respective load straight lines indicate stable points of an operation thereof.

As a load ($1/R_L$) further increases or increases as represented by $(1/R_L)>1/(H_{fb}\cdot R_{IS}\cdot M_{IS})$ and an output current $I_o$ reaches ($V_{ref}/R_{IS}/M_{IS}$), a constant voltage power source circuit starts an overcurrent limitation operation. In such a case, a detection signal OCP that indicates an overload state is activated.

Subsequently, even though a load increases for a while, an output current $I_o$ is constant as $I_o=V_{ref}/R_{IS}/M_{IS}$ and a constant voltage power source circuit operates as a constant current source. In such a case, an output voltage $V_o$ is lowered than a setting voltage ($V_{ref}\cdot H_{fb}$) with increasing a load. Additionally, such a preceding operation is identical to a dropping overcurrent protection characteristic of a constant voltage power source circuit according to the first embodiment as illustrated in FIG. 3.

As a load further increases and an output voltage $V_o$ is lowered than ($V_{ref}\cdot H_{fb}-D_{ofs}\cdot V_{ref}\cdot H_{fb}$), a constant voltage power source circuit according to the present embodiment starts an overcurrent protection operation. Subsequently, as a load further increases, both an output voltage $V_o$ and an output current $I_o$ are decreased.

As a slope thereof ($V_o/I_o$) is $V_o/I_o=H_{fb}\cdot R_{IS}\cdot M_{IS}$ and an offset ratio $D_{ofs}$ is set at a small value of approximately 0.1, an output voltage $V_o$ and an output current $I_o$ rapidly decrease even if a load slightly increases in an overcurrent protection operation state, as illustrated in FIG. 9.

Such a slope and an offset ratio $D_{ofs}$ are freely settable by adjusting a ratio among the four resistance elements 153 to 156 that are connected to the offset adder 152 as already described.

In a case where a load is in a heavy state that is close to a short circuit, an output voltage $V_o$ decreases to approximately 0 V and an output current $I_o$ is $I_o=D_{ofs}\cdot V_{ref}/R_{IS}/M_{IS}$.

Subsequently, as a load decreases again, an output voltage $V_o$ and an output current $I_o$ describe an identical trajectory and are recovered. As a load ($1/R_L$) decreases again as represented by $(1/R_L)<1/(H_{fb}\cdot R_{IS}\cdot M_{IS})$, a normal constant voltage current source circuit is returned to and an output voltage $V_o$ is constant like $V_o=V_{ref}\cdot H_{fb}$. Then, a detection signal OCP that indicates an overload state is deactivated. That is, a constant voltage power source circuit according to the present embodiment exhibits an operation characteristic that describes a trajectory as indicated by a dotted arrow (iv).

As already described, points of intersection Q1 to Q5 between a voltage-current characteristic curved line and respective load straight lines indicate stable points of an operation thereof. That is, a voltage-current characteristic curved line that is drawn by plotting stable points indicates a foldback current limiting characteristic.

A purpose of providing an overcurrent protection output-voltage-current characteristic with a foldback current limiting characteristic is to enhance protection of a load and simultaneously protect a constant voltage power source circuit, per se, in a case of an overload state.

In a case of overcurrent protection with a dropping characteristic as illustrated in FIG. 3, an output voltage $V_o$ decreases with increasing a load ($1/R_L$) and an output current $I_o$ is constant, so that a load consumption power $P_L$ ($=V_o\cdot I_o$) that is consumed by such a load decreases. Such a load consumption power $P_L$ is represented by $P_L=R_L\cdot(V_{ref}/R_{IS}/M_{IS})^2$.

However, a voltage of a supply power source Vi and an output current $I_o$ are constant, so that a power $P_{drv}$ ($=Vi\ I_o-P_L$) that is consumed by a PMOS output transistor 5 that composes a constant voltage power source circuit rather increases with increasing a load ($1/R_L$) and decreasing a load consumption power $P_L$ that is consumed by such a load.

Such a consumption power $P_{drv}$ is converted into heat, so that a temperature of the PMOS output transistor 5 rises if it is left in an overload state. In a case of no overcurrent protection function, an output current $I_o$ increases with increasing a load ($1/R_L$), so that an amount of heat generation greatly increases.

Figure 10:
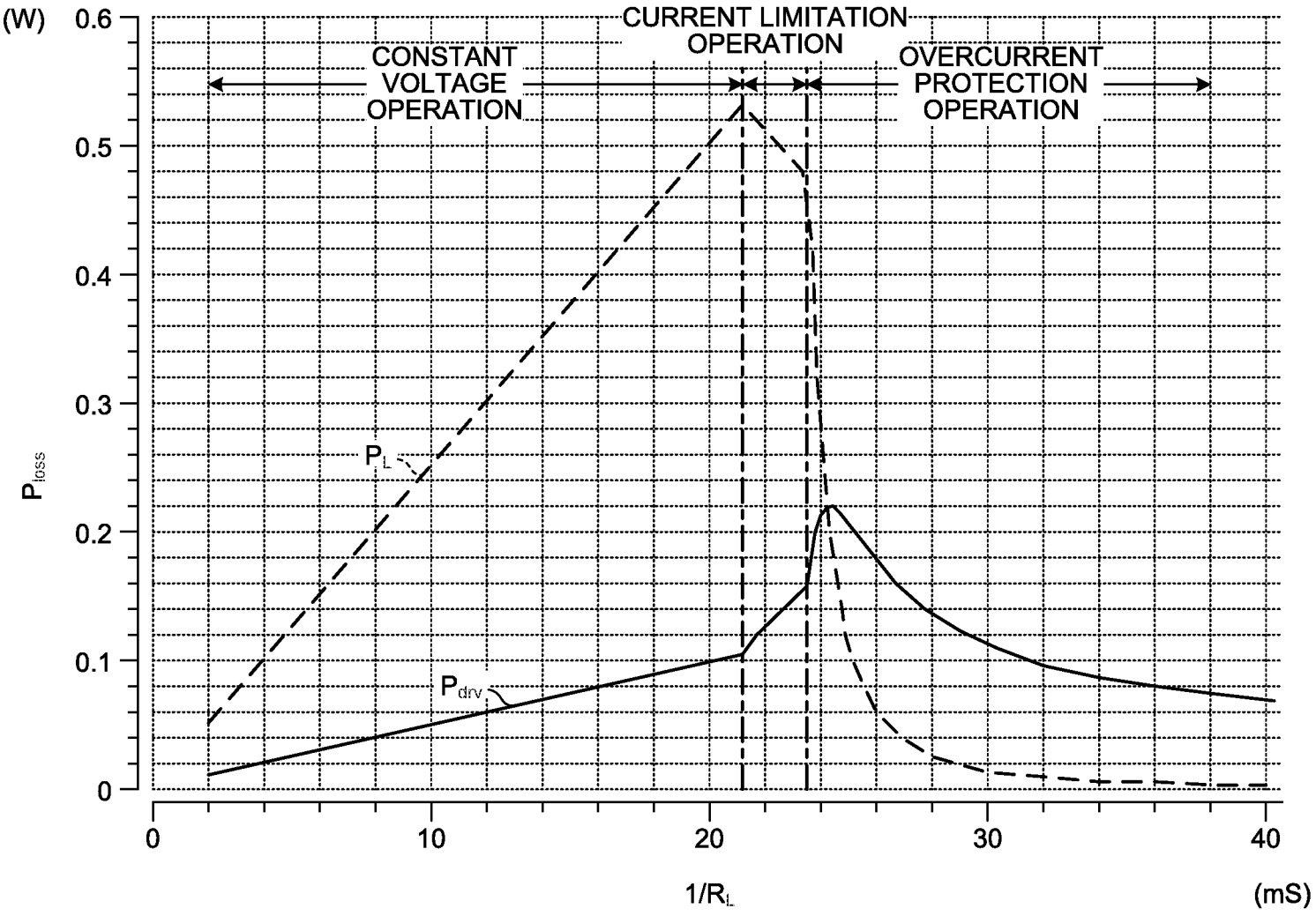
FIG. 10 is a diagram illustrating a power consumption characteristic of a constant voltage power source circuit according to the third embodiment.

A relationship between a load consumption power $P_L$ of a constant voltage power source circuit according to the present embodiment and a power $P_{drv}$ that is consumed by the PMOS output transistor 5 that are indicated by a broken line and a solid line, respectively, is provided in FIG. 10. A broken line indicates a load consumption power $P_L$ and a solid line indicates a power $P_{drv}$ that is consumed by the PMOS output transistor 5. An overcurrent protection voltage-current characteristic of a constant voltage power source circuit according to the present embodiment is a foldback current limiting characteristic.

A load consumption power $P_L$ during a constant voltage operation increases with increasing a load ($1/R_L$) and is maximized at a boundary with a current limitation operation.

A load consumption power $P_L$ ($=V_o\cdot I_o$) during a current limitation operation decreases, because an output voltage $V_o$ decreases with increasing a load ($1/R_L$) whereas an output current $I_o$ is kept constant.

As a load ($1/R_L$) is further increased to start an overcurrent protection operation, both an output voltage $V_o$ and an output current $I_o$ decrease, so that a load consumption power $P_L$ decreases rapidly. On the other hand, a power $P_{drv}$ ($=Vi\ I_o-P_L$) that is consumed by the PMOS output transistor 5 increases with increasing a load ($1/R_L$) in a constant voltage operation.

Even though a load ($1/R_L$) further increases to start a current limitation operation, a power $P_{drv}$ that is consumed by the PMOS output transistor 5 continues to increase and a slope thereof is rather steep. However, as an overcurrent protection operation is started and a load ($1/R_L$) further continues to increase, an effect of decreasing of an output current $I_o$ starts to appear and a power $P_{drv}$ that is consumed by the PMOS output transistor 5 starts to decrease.

Thus, an overcurrent protection function with a foldback current limiting characteristic that is possessed by a constant voltage power source circuit according to the present embodiment rapidly decreases a power that is consumed by a load even in a case where a load increases and an overload state is caused, so that it is possible to prevent a load from being broken. Simultaneously, a power that is consumed by an output transistor that composes a constant voltage power source circuit is also decreased, so that the PMOS output transistor 5 is also prevented from being broken.

Additionally, for readily understanding a constant voltage power source circuit according to the present embodiment, such a circuit is configured by using the differential amplifiers 3 and 8 and a structure and an effect thereof has been described. In an actual circuit, as illustrated in a constant voltage power source circuit according to the second embodiment, packaging thereof is executed by using differential voltage current amplifiers 31 and 81 and phase compensation circuits 32 and 82 are added thereto, so that feedback control loops for the voltage feedback circuit 110 and the current feedback circuit 120 are stabilized. Although a detailed description of a configuration thereof is omitted, FIG. 11 illustrates an operation waveform of a constant voltage power source circuit configured in such a manner that the differential voltage current amplifiers 31 and 81 and the phase compensation circuits 32 and 82 are added to a constant voltage power source circuit according to the third embodiment.

Figure 11:
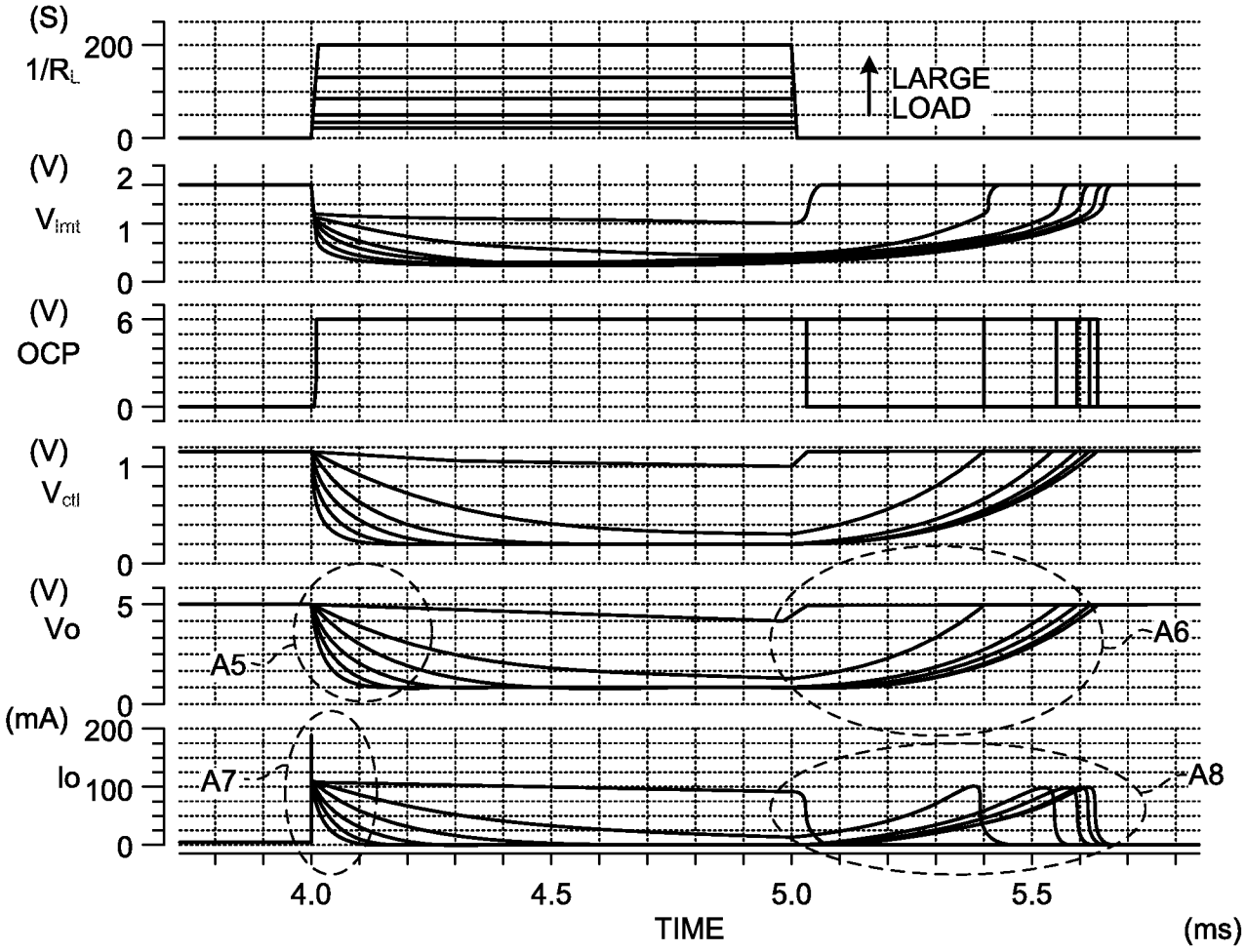
FIG. 11 is a diagram illustrating a response characteristic for a load variation of a constant voltage power source circuit according to the third embodiment.

FIG. 11 illustrates behavior of an output voltage $V_o$ and an output current $I_o$ in a case where a resistance load ($1/R_L$) that is connected to an output terminal 12 instantaneously changes from a light state (2 mS) to a heavy state (24 mS to 200 mS), then a certain period of time has passed, and subsequently an instantaneous change to the light state (2 mS) is executed again, similarly to an operation waveform diagram of FIG. 7 that is used to illustrate an operation of a constant voltage power source circuit according to the second embodiment in FIG. 4. As both of them are compared, a difference in an operation of a constant voltage power source circuit according to the third embodiment is found.

Behavior of each signal immediately after 4 ms when a resistance load ($1/R_L$) instantaneously changes from a light state (2 mS) to a heavy state (24 mS to 200 mS) is identical between an example of a constant voltage power source circuit according to the second embodiment that has an overcurrent protection function with a dropping characteristic and a constant voltage power source circuit according to the third embodiment that has an overcurrent protection function with a foldback current limiting characteristic. As a resistance load ($1/R_L$) instantaneously increases at a time of 4 ms, an output voltage $V_o$ drops as indicated by a dotted circle A5 in a waveform diagram of an output voltage $V_o$ in FIG. 11.

Subsequently, behavior is different in a case where an overload state continues. Whereas an output current $I_o$ in overcurrent protection with a dropping characteristic is kept at a current limitation value that is set according to $I_o=V_{ref}/R_{IS}/M_{IS}$, that is, a constant value of approximately 100 mA, an output current $I_o$ in overcurrent protection with a foldback current limiting characteristic is gradually lowered as indicated by a dotted circle A7, and then, both the output current $I_o$ and an output voltage $V_o$ are stabilized in a very low state depending on a magnitude of a resistance load ($1/R_L$).

As a resistance load ($1/R_L$) is rapidly changed to a light state (2 mS) at a time of 5 ms again, an output current $I_o$ and an output voltage $V_o$ thereof start to be recovered in both the second embodiment for a dropping characteristic and the third embodiment for a foldback current limiting characteristic.

A recovery speed of such an output current $I_o$ and an output voltage $V_o$ in a constant voltage power source circuit according to the third embodiment is slower than that in a constant voltage power source circuit according to the second embodiment. A constant voltage power source circuit according to the third embodiment is provided in a state where an output voltage $V_o$ at a time of overloading is very low, so that a period of time that is needed for recovery thereof is long.

In a case where an output voltage $V_o$ returns to a constant voltage state, an output current $I_o$ reaches a peak thereof, and subsequently, an output current $I_o$ rapidly decreases according to a light load state, as indicated by a dotted circle A8. Additionally, a peak value of an output current $I_o$ is identical to a current limitation value that is set according to $I_o=V_{ref}/R_{IS}/M_{IS}$, that is, approximately 100 mA.

Furthermore, immediately after an output voltage $V_o$ returns to a constant voltage, an overshoot where such an output voltage $V_o$ exceeds a setting value is not caused as indicated by a dotted circle A6. Furthermore, an output voltage $V_o$ and an output current $I_o$ in a protection operation as illustrated in FIG. 11 are not discontinuous except a period of time immediately after rapid transfer to an overload state is caused and before an overcurrent protection operation is started. Moreover, as long as phase compensation is appropriately applied thereto, an output voltage $V_o$ does not oscillate even in a case where a resistance load ($1/R_L$) is any value that includes that of an overload state.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A constant voltage power source circuit, comprising:

a voltage feedback circuit that controls an output voltage depending on a control voltage; and a current feedback circuit that detects an output current, keeps the control voltage at a constant voltage until the output current reaches a predetermined current value, and changes a value of the control voltage at a time when the output current reaches the predetermined current value, wherein the voltage feedback circuit includes:

an amplifier that outputs a signal dependent on a voltage difference between a feedback voltage dependent on the output voltage and the control voltage, and a first output transistor that is controlled by an output signal from the amplifier and supplies the output voltage to an output terminal, wherein the amplifier has an inverting input terminal and a non-inverting input terminal, the feedback voltage is supplied to the non-inverting input terminal, and the control voltage is supplied to the inverting input terminal, wherein the current feedback circuit has a second output transistor that composes a current mirror circuit together with the first output transistor, and wherein the voltage feedback circuit further includes a first phase compensation circuit that is connected between an output terminal of the amplifier and the non-inverting input terminal and compensates for a phase delay.

2. The constant voltage power source circuit according to claim 1, having a smoothing capacitor that is connected between the output terminal that is supplied with the output voltage and ground.

3. The constant voltage power source circuit according to claim 2, wherein the first phase compensation circuit has:

a first capacitance that is connected between the output terminal of the amplifier and the output terminal; and a second capacitance that is connected between the output terminal and the non-inverting input terminal of the amplifier.

4. The constant voltage power source circuit according to claim 1, wherein the current feedback circuit comprises:

a differential amplifier that is supplied with a feedback voltage dependent on the output current and a predetermined reference voltage and amplifies a difference voltage therebetween to output an output;

a comparator that compares the predetermined reference voltage with the output of the differential amplifier; and a selection circuit that selects and supplies to the amplifier, either one of the predetermined reference voltage and the output of the differential amplifier in response to an output of the comparator.

5. The constant voltage power source circuit according to claim 4, wherein the selection circuit selects and outputs the output of the differential amplifier at a time when the reference voltage is higher than the output of the differential amplifier.

6. The constant voltage power source circuit according to claim 4, wherein the differential amplifier has a non-inverting input terminal that is supplied with the predetermined reference voltage and an inverting input terminal that is supplied with the feedback voltage dependent on the output current, further comprising a second phase compensation circuit that is connected between the inverting input terminal of the differential amplifier and an output terminal of the differential amplifier and compensates for a phase delay.

7. The constant voltage power source circuit according to claim 6, wherein the second phase compensation circuit has a first resistance and a third capacitance that are connected in series between the inverting input terminal and the output terminal of the differential amplifier.

8. The constant voltage power source circuit according to claim 7, wherein:

the second phase compensation circuit further has a switch that is connected to the third capacitance in parallel; and on/off of the switch is controlled by an output of the comparator.

9. A constant voltage power source circuit, including:

a reference voltage output circuit that outputs a reference voltage;

a first amplifier that amplifies a difference voltage between the reference voltage and a feedback voltage dependent on an output current to output an output;

a first comparator that compares the output of the first amplifier with the reference voltage;

a first selection circuit that selects and outputs either one of the reference voltage and the output of the first amplifier in response to an output of the first comparator;

a second amplifier that is supplied with an output of the first selection circuit and a feedback voltage dependent on an output voltage and amplifies a difference voltage therebetween to output a driving voltage; and a first output transistor that is provided with a control electrode that is supplied with the driving voltage, and supplies the output voltage to an output terminal.

10. The constant voltage power source circuit according to claim 9, wherein the first selection circuit selects and outputs the output of the first amplifier at a time when the reference voltage is higher than the output of the first amplifier.

11. The constant voltage power source circuit according to claim 10, including:

a second output transistor with a control electrode that is supplied with the driving signal; and a resistance that is supplied with an output from the second output transistor, wherein a voltage that is generated by the resistance is supplied to the first amplifier as the feedback voltage dependent on the output current.

12. The constant voltage power source circuit according to claim 11, having a smoothing capacitor that is connected between the output terminal and ground.

13. A constant voltage power source circuit, including:

a reference voltage output circuit that outputs a reference voltage;

a voltage generation circuit that outputs a voltage provided in such a manner that a voltage that is predetermined times as much as the reference voltage is added to a feedback voltage dependent on an output voltage;

a first selection circuit that selects and outputs either one of the reference voltage and an output of the voltage generation circuit;

a first amplifier that amplifies a difference voltage between an output of the first selection circuit and a feedback voltage dependent on an output current to output an output;

a second selection circuit that selects and outputs either one of the reference voltage and the output of the first amplification circuit;

a second amplification circuit that is supplied with an output of the second selection circuit and the feedback voltage dependent on the output voltage and amplifies a difference voltage therebetween to output a driving voltage; and an output transistor that is provided with a control electrode that is supplied with the driving signal, and supplies the output voltage to an output terminal.

14. The constant voltage power source circuit according to claim 13, wherein the second selection circuit selects and outputs an output of the first amplifier at a time when the reference voltage is higher than the output of the first amplifier.

* * * * *